US006643220B2

(12) United States Patent
Anderson et al.

(10) Patent No.: US 6,643,220 B2
(45) Date of Patent: Nov. 4, 2003

(54) VAPOR HANDLING IN PRINTING

(75) Inventors: Richard Anderson, Escondido, CA (US); Yi-Hua Tsao, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 22 days.

(21) Appl. No.: 10/103,248

(22) Filed: Mar. 21, 2002

(65) Prior Publication Data

US 2003/0179260 A1 Sep. 25, 2003

(51) Int. Cl.[7] ..... B41J 2/165
(52) U.S. Cl. ..... 367/34; 347/18
(58) Field of Search ..... 347/18, 34, 102, 347/22; 34/73, 92, 79; 101/424.1

(56) References Cited

U.S. PATENT DOCUMENTS 4,901,094 A 2/1990 Iwagami et al. ..... 347/36
5,329,306 A * 7/1994 Carlotta ..... 347/90
6,176,563 B1 * 1/2001 Anderson et al. ..... 347/22
6,397,488 B1 * 6/2002 Brinkly ..... 34/92

* cited by examiner

*Primary Examiner*—Shih Wen Hsieh

(57) ABSTRACT

Apparatus and methods are disclosed for enabling vapor handling in printing. In certain implementations, for example, one or more volatiles emitted during an ink-based printing process may be condensed into one or more liquids. The one or more liquids may be directed into absorbent materials such that the combined liquids and absorbent materials form a substance that qualifies as a solid, as determined by a given solid definition or regulatory standard. In certain (alternative but non-exhaustive) implementations, the volatiles emitted during printing may include water and oil, with the oil vapor being condensed into a liquid and added to the absorbent materials while the water vapor is being forwarded under the force of, e.g., negative air pressure.

33 Claims, 6 Drawing Sheets

VAPOR HANDLING IN PRINTING

BACKGROUND

The present invention relates generally to waste management, and more specifically to vapor handling in ink-based printing devices.

Ink-based printing devices are used in many different types of printing environments. For example, ink-jet printers are used in stand-alone environments attached to individual computers. Ink-jet printers are also used in networked environments as printing devices that are utilized by a number of network clients and attached thereto via network connections. As another example of an ink-based printing device, ink-using web printers are capable of printing many "pages" of text and graphics from a single roll of paper, which may then be cut into separate or groups of pages for subsequent formation into a newspaper, a newsletter, etc. As yet another example of ink-based printing devices, ink-using copiers, facsimile machines, multi-function devices, etc. may each rely on an ink-based print engine to create printed hard copies. These various ink-printing devices may print using black, color, or black and color inks.

With these many attractive options, ink-based printing devices have become ubiquitous in society. Furthermore, these printers provide many other desirable characteristics at an affordable price. However, the desire of customers for ever more features or conveniences (usually at ever-lower prices) continues to encourage manufacturers to improve efficiencies and other attributes of ink-based printing devices. One area of continual improvement is in printer throughput, in increased pages per minute.

As throughput increases, however, problems related to throughput become more significant, such as the generation of waste products, including vapors generated during the printing process. These vapors may include substances which must be disposed of in compliance with to hazardous waste procedures, such as described in the United States Environmental Protection Agency (EPA) regulations. Currently, addressing ink waste issues can be an expensive and time consuming aggravation for consumers of ink-based printing devices. There is thus a need for methods and apparatus that simplify the waste recovery and disposal process.

SUMMARY

One or more of the deficiencies and problems described above are ameliorated or eliminated by embodiments of the present invention. Embodiment of the present invention simplify or reduce the cost of addressing ink waste issues by enabling an operator to relatively easily and inexpensively handle vapor that is produced as a waste byproduct of printing with ink-based printing devices.

To that end, apparatuses, methods, systems, and arrangements as described herein facilitate vapor handling in printing. In certain implementations, for example, one or more volatiles emitted during an ink-based printing process may be condensed into one or more liquids. The one or more liquids may be directed into absorbent materials such that the combined liquids and absorbent materials form a substance that qualifies as a solid, as determined by a given solid definition or regulatory standard. In certain (alternative but non-exhaustive) implementations, the volatiles emitted during printing may include water and oil vapors, with the oil vapor being condensed into a liquid and added to the absorbent materials while the water vapor is being forwarded under the force of, e.g., negative air pressure.

The above-described and other features and aspects are explained in detail hereinafter in the Detailed Description with reference to the illustrative examples shown in the accompanying Drawings. Those skilled in the art will appreciate that the described or illustrated implementations are provided for purposes of explanation and understanding and that numerous alternative or equivalent implementations are suggested herein or contemplated hereby.

BRIEF DESCRIPTION OF THE DRAWINGS

A more complete understanding of the apparatuses, methods, systems, and arrangements may be had by reference to the following Detailed Description when taken in conjunction with the accompanying drawings wherein.

DETAILED DESCRIPTION

In the following Detailed Description, for purposes of explanation and not limitation, specific details are set forth, such as particular physical shapes, structural features, numbers of parts, modular components, operative or formative techniques, methodological steps, etc. in order to provide a thorough understanding. However, it will be apparent to one of ordinary skill in the art that the present invention may be practiced in other implementations that depart from these specific details. In other instances, detailed descriptions of well-known techniques, components, materials, manufacturing approaches, etc. are omitted so as not to obscure the description with unnecessary detail.

Exemplary implementations are best understood by referring to FIGS. 1–6 of the Drawings, like numerals being used for like or corresponding features, aspects, and components of the various drawings.

Figure 1:
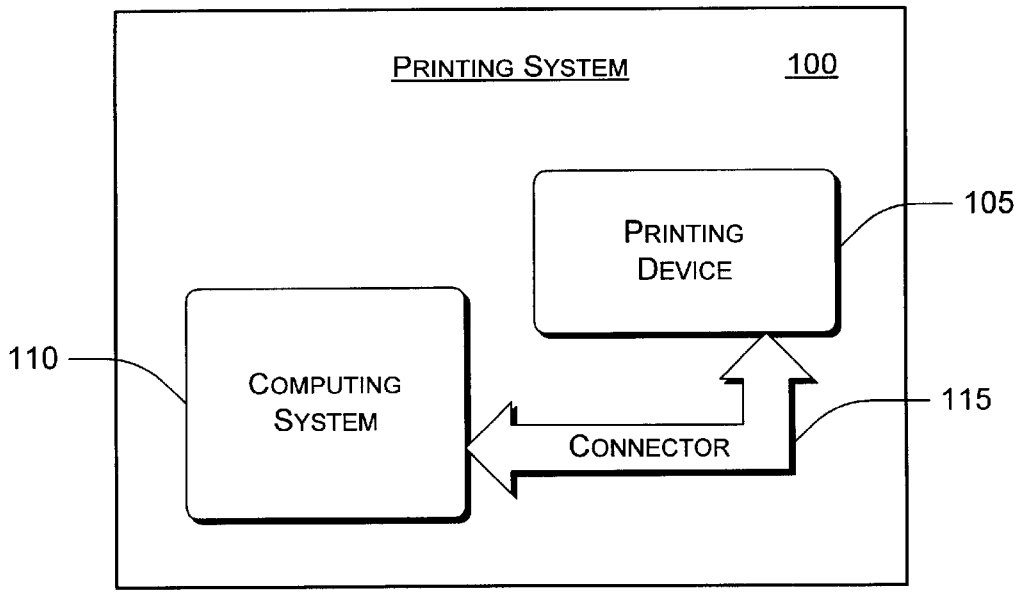
FIG. 1 illustrates an exemplary printing system implementation.

FIG. 1 illustrates an exemplary printing system implementation at 100. The exemplary printing system implementation 100 may include a printing device 105 and a computing system 110, which may be in communication with each other via a connector 115. The printing device 105 may represent any one of many different types and sizes (e.g., physical dimensions and operative capacity) of multifunction printing devices. In other words, the printing device 105 may be, for example, a handheld printer; a multifunction desktop machine having printing, faxing, copying, and scanning features; a high capacity "industrial strength" printer (e.g., capable of approximately 50,000 copies monthly), a web printer, some blend or combination thereof, etc. The computing system 110 may be, for example, a palm-sized computer, a lap-top computer, a desktop computer, a mainframe computer, a network of any given size, some blend or combination thereof, etc.

The connector 115 provides a communication link between the computing system 110 and the printing device 105. The manner in which the connector 115 creates such a communication link depends, for example, on the constituents of which the computing system 110 is composed or the capabilities of the printing device 105. For instance, the connector 115 may be a network connector operating under, e.g., an Ethernet protocol, an internet protocol (IP), etc. Alternatively, the connector 115 may be a local connector operating under, e.g., a parallel cable protocol, a Universal Serial Bus (USB) protocol, an IEEE 1394 ("FireWire") protocol, etc. Other protocols and connection mechanisms may instead be used to realize the connector 115, such as a wireless protocol (e.g., Bluetooth®, IEEE 802.11b, wireless Local Area Network (LAN), etc.). Additionally, it should be understood that the above-described examples for the printing device 105 and the computing system 110 are only exemplary and are non-exhaustive and that numerous other implementations will be apparent to those of ordinary skill in the art after reading and understanding the principles and techniques described herein.

Figure 2:
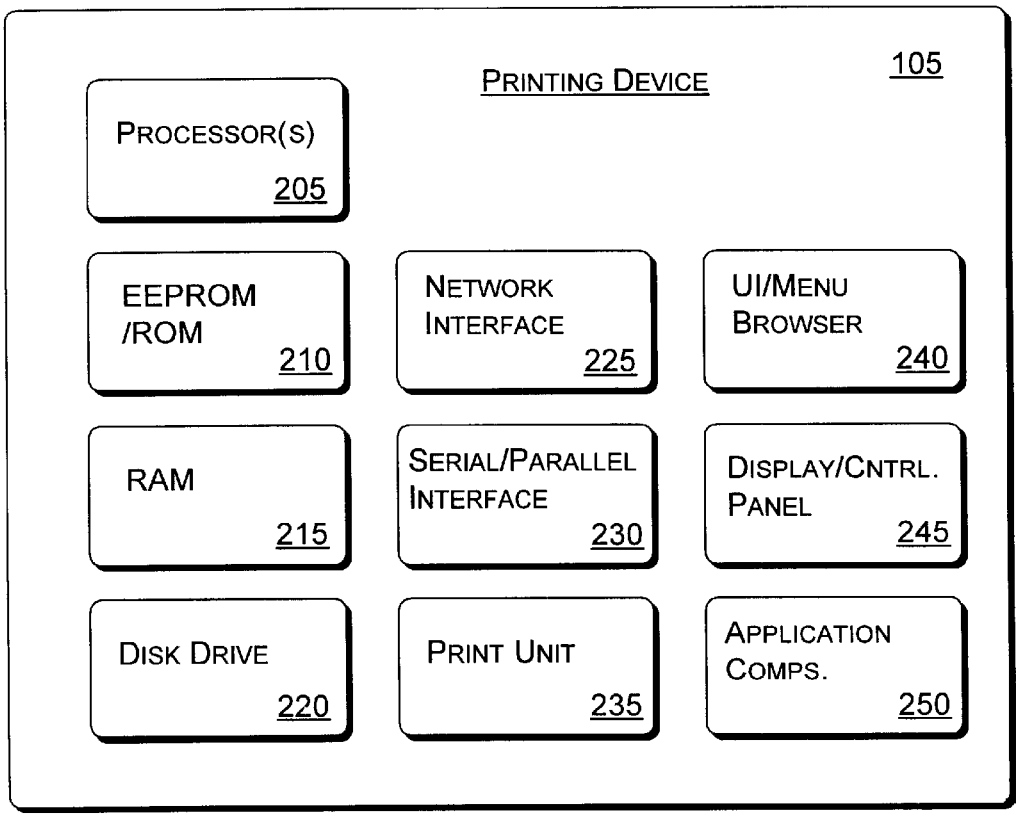
FIG. 2 is a block diagram that illustrates various exemplary components of an exemplary multifunction printing device implementation.

FIG. 2 is a block diagram at 105 illustrating various exemplary components of an exemplary multifunction printing device implementation. An exemplary multifunction printing device, as the name implies, is a device capable of multiple functions which are related, but not necessarily limited, to one or more of the following: printing; copying; scanning, including image acquisition and text recognition; sending and receiving faxes; print media handling; or data communication, either by print media or e-media, such as via email or electronic fax. It should be noted that a multifunction printing device need not include other functions beyond that of printing. Furthermore, the term "printing device" is used herein, including in the Drawings and in the Claims, to represent and include a multifunction printing device. In other words, a "printing device" may (but need not necessarily) have other features in addition to printing, such as copying, scanning, faxing, etc.

The exemplary printing device 105 may include one or more processors 205, an electrically erasable programmable read-only memory (EEPROM) or read-only (non-erasable) memory (ROM) 210 and a random access memory (RAM) 215. It should be understood that the printing device 105 may have one of, both of, or neither an EEPROM nor a ROM 210. Also, if there are two such memory components, they may be integrated on a single chip, separate, etc. Additionally, although not explicitly shown, a system bus may connect and interconnect the various illustrated components within the printing device 105.

The printing device 105 may also include a firmware component (not explicitly shown) that may be implemented as a, e.g., permanent memory module portion of the EEPROM or ROM 210. The firmware may be programmed and tested like software, and it may be distributed with the printing device 105. The firmware may be implemented to coordinate operations of the hardware within the printing device 105 when, for example, it stores programming constructs used to perform such operations. It should be understood that the EEPROM or ROM 210, including any firmware portion, may instead be realized using some other type of memory such as flash memory.

The processors 205 process various instructions to control the operation of the printing device 105 and optionally to communicate with other electronic or computing devices. The memory components (e.g., EEPROM or ROM 210, RAM 215, etc.) store various information or data such as configuration information, fonts, templates, print data, scanned image data, and menu structure information, depending on the functions provided by and being used with the printing device 105. It should also be understood that a particular printing device 105 may include a flash memory component in addition to the EEPROM or ROM 210 (e.g., for firmware updating).

The printing device 105 may also include a disk drive 220, a network interface 225, and a serial or parallel interface 230. The disk drive 220 provides additional storage for data being printed, copied, scanned, or faxed, or other information maintained by or for the printing device 105. Although the printing device 105 is illustrated as having both the RAM 215 and the disk drive 220, a particular printing device 105 may alternatively include either a RAM 215 or a disk drive 220, depending on the storage needs of the printing device. It should be understood that the disk drive 220 (as well as the RAM 215) may alternatively be substituted with or complemented by another removable and rewritable storage medium, such as a flash memory card, a removable hard drive, or a proprietary format device.

The network interface 225 may provide a connection between the printing device 105 and a data communication network (or a specific device connected over a network-type medium). The network interface 225 allows devices coupled to a common data communication network to send print jobs, faxes, menu data, and other information to printing device 105 via the network. Similarly, the serial or parallel interface 230 may provide a data communication path directly between the printing device 105 and another electronic or computing device. Although the printing device 105 is illustrated as having the network interface 225 and the serial or parallel interface 230, a particular printing device 105 may only include one such interface component. It should be understood that the printing device 105 may alternatively substitute or add another interface connection type, such as a Universal Serial Bus (USB) interface, an IEEE 1394 ("Firewire") interface, a wireless interface (e.g., Bluetooth®, IEEE 802.11b, wireless Local Area Network (LAN), etc.), etc.

The printing device 105 may also include a print unit 235 that includes mechanisms arranged to selectively apply ink (e.g., liquid ink, toner ink, etc.) to a print media such as paper, plastic, fabric, and the like in accordance with print data corresponding to a print job. For example, the print unit 235 may include a laser printing mechanism that selectively causes toner to be applied from ink containers to an intermediate surface of a drum or belt. The intermediate surface can then be brought in the proximity of a print media in a manner that causes the toner to be transferred to the print media in a controlled fashion. The toner on the print media can then be more permanently fixed to the print media, for example, by selectively applying thermal energy to the toner. Alternatively, the print unit 235 may include an ink jet printing mechanism that selectively causes liquid to be ejected from ink containers through nozzles and onto print media to form an intended pattern (e.g., text, pictures, etc.).

The print unit 235 may also be designed or configured to support duplex printing, for example, by selectively flipping or turning the print media as required to print on both sides. Those of ordinary skill in the art will recognize that there are many different types of print units available and that the print unit 235 may be composed of any one or more of these different types.

The printing device 105 may also optionally include a user interface (UI) or menu browser 240 and a display or control panel 245. The UI or menu browser 240 allows a user of the printing device 105 to navigate the device's menu structure (if any). A control aspect of the display or control panel 245 may be composed of indicators or a series of buttons, switches, or other selectable controls that are manipulated by a user of the printing device 105. A display aspect of the display or control panel 245 may be a graphical display that provides information regarding the status of the printing device 105 and the current options available to a user through, e.g., a menu structure.

The printing device 105 may, and typically does, include application components 250 that provide a runtime environment in which software applications or components can run or execute. Those of ordinary skill in the art will recognize that there are many different types of available runtime environments, which facilitate the extensibility of the printing device 105 by allowing various interfaces to be defined that, in turn, allow the application components 250 to further interact with the printing device 105.

Figure 3:
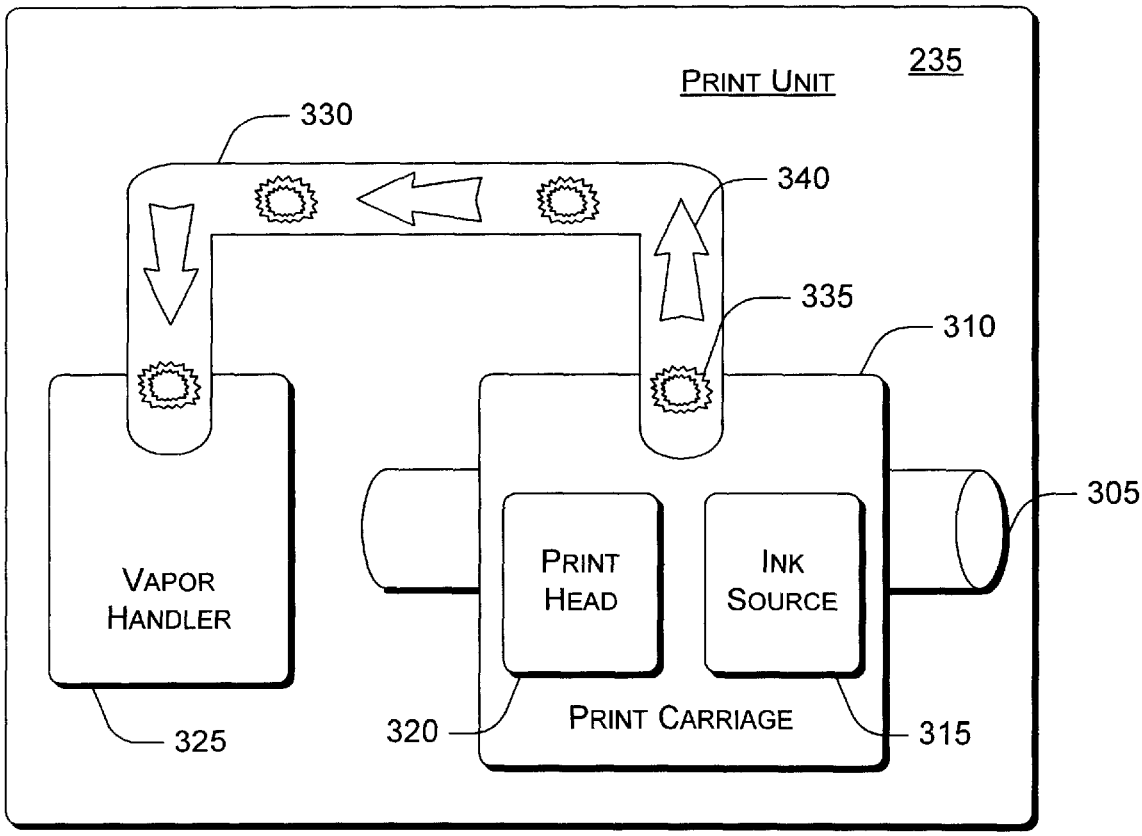
FIG. 3 illustrates an exemplary print unit implementation having an exemplary vapor handler.

FIG. 3 illustrates an exemplary print unit implementation at 235 having an exemplary vapor handler 325 according to the present invention. The exemplary print unit implementation 235 may include a print carriage 310 that prints onto a print media (not explicitly shown) that may be guided through the printing device 105 (of FIGS. 1 and 2) through a media routing assembly as represented by the platen 305. The print carriage 310, which may be fixed or mobile, may include a printhead 320 and an ink source 315. The ink source 315 may hold color or black inks. The printhead may include print nozzles or pins (not explicitly shown) that cause the inks of the ink source to be applied to print media in accordance with instructions from a print job. The inks of the ink source 315 may be composed, for example, of ink toners (or, more generally, pigments), oils, and water. When heat is applied to the inks of the ink source 315 during the printing process by the printhead 320, small quantities of the oils and water are typically heated to such a degree that they become vapor as the ink toner is transferred onto the print media. Other mechanisms, such as evaporation, also account for small quantities of volatile oils and water becoming vapor.

These oil and water vapors, individually or collectively referred to herein as waste products, are therefore created during the printing process. If the oil and water vapors are merely released into the environment surrounding the printing device 105, the surroundings thereof can gradually become coated with an unpleasantly sticky oil. If the oil and water vapors are merely combined into a container and allowed to jointly condense into liquids, the combined liquid must be disposed of with adherence to particular hazardous waste procedures as dictated by current Environmental Protection Agency (EPA) regulations. This may require that an operator of a printer become a party to an expensive or inconvenient agreement with an outside contractor who can properly dispose of the combined oil and water liquid. On the other hand, if the oil vapors are condensed and directed into a substances of predetermined characteristics such that the combined oil liquids and substances meet the EPA regulatory definition of a solid, then the combined oil liquids and substances (now qualifying as one or more solids) may be disposed of with ordinary refuse, for example, in regular trash destined for a city landfill.

To successfully transform oil vapors into a solid, print units 235 may incorporate a vapor handler 325, which is described in further detail below, for example, with reference to FIGS. 4A and 4B. It should be noted that a vapor handler 325 need not be located fully or even partially within the print unit 235. An air passageway 330 provides a path between the print carriage 310 and the vapor handler 325. The passageway 330 may be formed of a separate piece or pieces of material or materials (e.g., from a plastic or similar material, a metal, another material suited to containing water and oil vapors, etc.), or integrated into the print unit 235 (or another part of the printing device 105). Water and oil vapors 335 flow through the passageway 330 (at least primarily) in the direction of the arrows 340. The flow of the water and oil vapors 335 may be encouraged by a partial vacuum (or, more generally, a negative air pressure that pulls or a positive air pressure that blows/pushes). It should be understood that actual water and oil vapors need not "clump" together as illustrated in the present application for purposes of clarity. It should also be understood that the passageway 330 may have, instead of the two bends illustrated, a different number of bends or no bends along its path. Once the water and oil vapors 335 reach the vapor handler 325, the vapor handler 325 may transform the oil vapor content of the water and oil vapors 335 into a solid, e.g., that meets the EPA regulatory definition thereof to facilitate easier and cheaper disposal of the waste products.

Figure 4A:
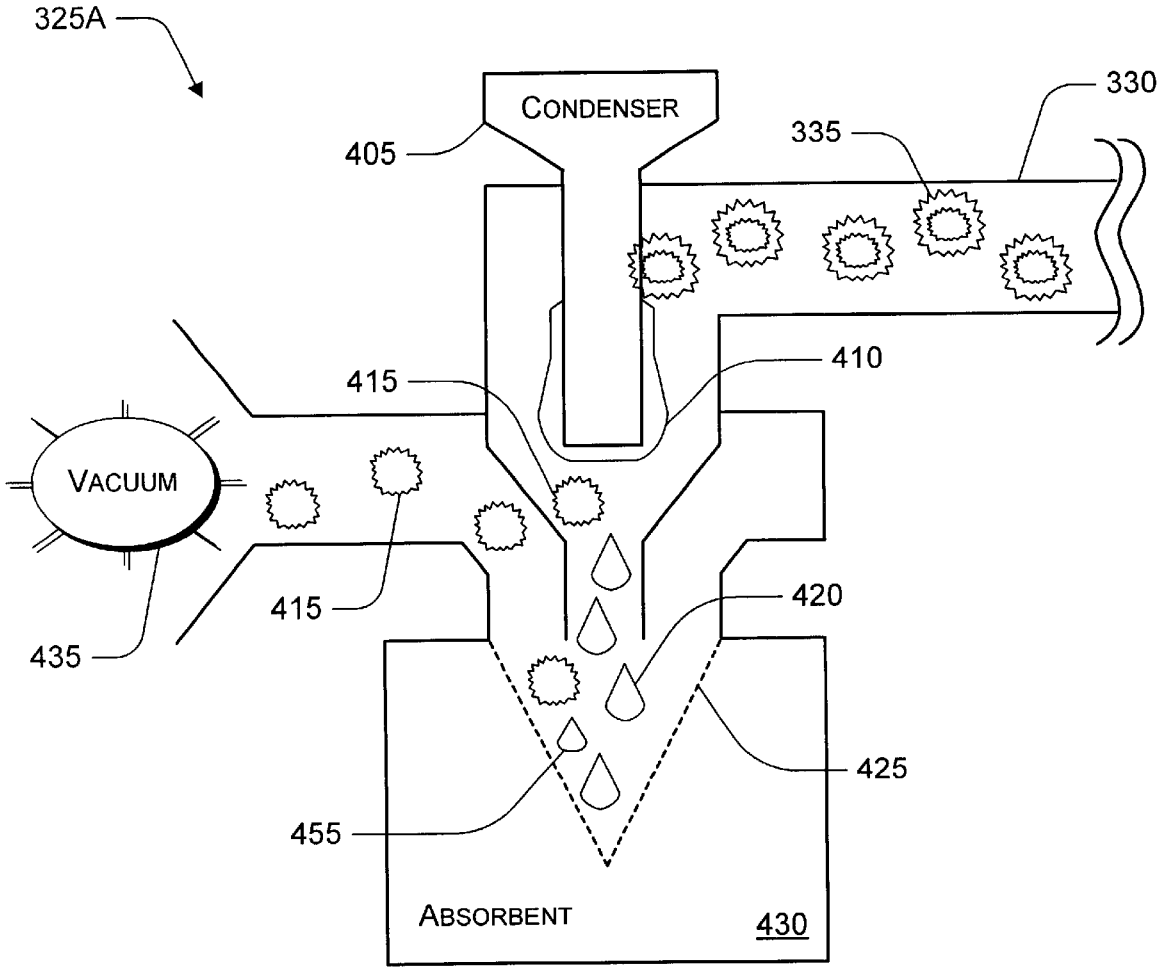
FIG. 4A illustrates a first exemplary vapor handler implementation.

FIG. 4A illustrates generally at 325A a first exemplary vapor handler implementation. The first exemplary vapor handler implementation 325A illustrates the passageway 330 (none, all, or a portion of which may be part of the vapor handler implementation 325A) that guides the water and oil vapors 335 along to a condenser 405. The condenser 405 may be realized as, for example, a so-called "cold finger" (typically a hollow tube carrying a cooling fluid) that may reduce the average temperature of the incoming water and oil vapors 335. The temperature of the condenser 405 may be set such that the, e.g., average temperature of the water and oil vapors 335 is reduced to a temperature that condenses the oil vapors to oil liquids but still above a temperature that would ordinarily condense much if any of the water vapor to water liquid. To that end, the oils used in the inks of the ink source 315 (of FIG. 3) may be selected such that their volatility is lower than that of water. In other words, the oil solvents may be selected based on their having a boiling point that is greater than that of water.

With continuing reference to FIG. 4A, the condenser 405 cools the water and oil vapors 335 so that the oil vapors become oil liquids 410 and the water vapor is separated out as water vapor 415. The oil liquids 410 may fall as oil drops (or streams or similar) 420. Some of the water vapor, however, may be condensed into water liquid that may commingle with the oil liquids 410 at the condenser 405 and fall as water drops (or streams or similar) 455. The oil drops 420 and the water drops 455, if any, fall (e.g., under the influence of gravity or they may be propelled by another force, etc.) through, e.g., a chamber, pipe, or the like towards and thru a boundary 425 and into an absorbent 430. The boundary 425 may be a physical dividing lines (or planes) between the absorbent 430 and the surrounding atmosphere (e.g., air and the water vapor 415), may be a membrane holding the absorbent 430 in a desired position or retarding the entry of water vapor 415, etc. The absorbent 430 may be realized as, for example, a powder, a spongy-type material, a gel-like material, or a combination thereof. Exemplary absorbent materials include silica gel (tradenames such as Aerosil, Cab-O-Sil, Syloid, Sylojet, etc.); cellulose fibers; water-swellable polymers such as polyvinyl alcohol, cellulose, polyvinylpyrrolidone, polyethylene oxide, polyethylene glycol and polyacrylamide; calcium carbonate, and clay. Other suitable absorbent materials are known in the art.

It may be advantageous from a disposal perspective to ensure that the selected absorbent 430, even after addition of the oil drops 420 (and any water drops 455), remains or becomes a solid under any or all applicable regulatory guidelines, standards, or laws. One standard/regulation that provides a guideline/method for determining whether a substance qualifies as a "solid" is, by way of example but not limitation, the 9095A "Paint Filter Liquids Test" promulgated by the United States Environmental Protection Agency (EPA). In the Paint Filter Liquids Test, a predetermined amount of material is placed in a paint filter. If any portion of the material passes through and drops from the filter within a five minute test period, the material is deemed to contain free liquids. If no material passes through the filter, the material is deemed a "solid" for disposal purposes.

Again with reference to FIG. 4A, the water vapor 415 may propagate past, away from, or over the absorbent 430 under the force of a partial vacuum 435 and optionally ejected or otherwise introduced into the surrounding environment of the printing device 105. The partial vacuum 435 may be created using, for example, a pump or a fan.

Figure 4B:
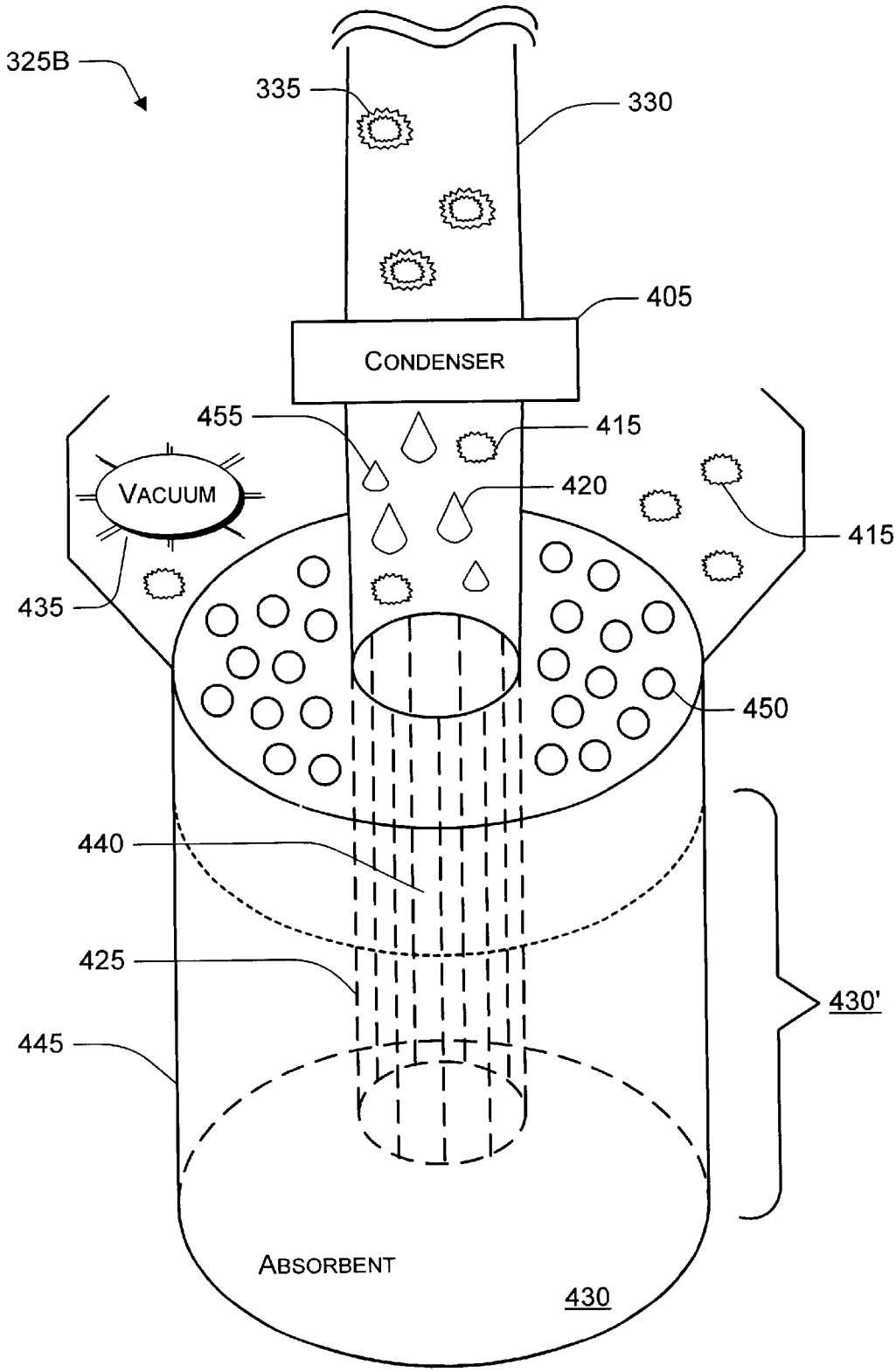
FIG. 4B illustrates a second exemplary vapor handler implementation.

FIG. 4B illustrates generally at 325B a second exemplary vapor handler implementation. The second exemplary vapor handler implementation 325B illustrates the passageway 330 that guides the water and oil vapors 335 therealong to the condenser 405. After the water and oil vapors 335 pass thru the condenser 405, the water and oil vapors 335 may be changed so that the oil vapors become oil drops (or streams or similar) 420 and the water vapor is separated out as water vapor 415. Some of the water vapor, however, may be condensed into water drops (or streams or similar) 455. The oil drops 420 and the water drops 455, if any, fall (e.g., under the influence of gravity or they may be propelled by another force) toward and into a smaller cylindrical tube 440 that is surrounded and partly defined by the membrane 425. The membrane 425, which may be realized with plastic, metal, vinyl, a derivate thereof, etc., may be permeable to the oil drops 420, any water drops 455, and the water vapor 415. The smaller cylindrical tube 440 may be surrounded (optionally in a concentric fashion) by a larger cylindrical tube 445. The vapor handler 325B also includes a quantity of the absorbent 430. The absorbent 430 may fill a particular amount, to a particular level, of the larger cylindrical tube 445 (and optionally the smaller cylindrical tube 440, also).

A height of this absorbent fill quantity is denoted by 430' (and the associated dashed curvilinear indicator). This absorbent fill height 430' may be determined based on any one or more of a number of factors such as: how many oil drops 420 and any water drops 455 are (e.g., total oil (and water) liquid volume is) expected between changes of the vapor handler 325B (or changes of the absorbent 430/larger cylindrical tube 445/smaller cylindrical tube 440 while the condenser is not changed), how much (if any) does the absorbent 430 swell as it absorbs the oil drops 420 and any water drops 455, how much space is desired between the top of the absorbent fill height 430' and the top of the larger cylindrical tube 445 for flow of the water vapor 415, etc. As the oil drops 420 and any water drops 455 propagate toward the absorbent 430, the water vapor 415 may enter the smaller cylindrical tube 440 and may flow thru the membrane 425, into the larger cylindrical tube 445, and then toward multiple apertures 450. It should be noted that the apertures 450 may also extend in "front" of and "behind" the path between the condenser 405 and the smaller cylindrical tube 440 (even though such apertures 450 are not explicitly shown to avoid unduly obfuscating the drawing). The water vapor 415 may continue toward and then thru the apertures 450, for example, under the influence of, e.g., a partial vacuum 435 or similar force.

As indicated above and in FIGS. 4A and 4B, with respect to both vapor handler implementations 325A and 325B as well as other implementations generally, the condenser may create water drops 455 as well as oil drops 420 from the water and oil vapors 335. The water drops 455 may be separate from or intermingled with the oil drops 420 as they both propagate towards and into the absorbent 430. While at least much of the water may remain as water vapor 415 after the condenser 405, some water likely cools sufficiently to become the water drops 455, which subsequently travel to the absorbent 430. In fact, in some implementations, the condenser 405 may intentionally be set to a temperature that almost certainly creates some water drops 455 to increase the likelihood that little or no oil vapor of the water and oil vapors 335 passes the condenser 405 without becoming oil drops 420. It should be noted that the relative sizes of the oil drops 420 and the water drops 455, as well as the ratio of the respective number of drops, as illustrated in FIGS. 4A and 4B, are not necessarily reflective of any particular implementation. It should also be noted that, due to real-world tolerances, some small amounts or traces of the oil vapors of the water and oil vapors 335 may pass the condenser 405 without being condensed into oil drops 420. Thus, some oil vapors may "escape" along with the water vapor 415.

Many other alternative implementations will be apparent to those of ordinary skill in the art after reading and understanding the principles described herein. For example, the vapor handler 325B may be reversed in the sense that the condenser 405 may forward oil drops 420 and water vapor 415 toward the larger cylindrical tube 445 so that the escaping water vapor 415 is thereafter withdrawn through the smaller cylindrical tube 440 (and any pipe or piping extending therefrom) under the force of a vacuum 435 or similar. As another example, the vapor handler implementation 325B illustrated in FIG. 4B may be modified by removing the (cylindrical) membrane 425 and substituting therefore either (i) nothing or (ii) a membrane parallel to the top and bottom of the larger cylindrical tube 445 at a height corresponding to the absorbent fill height 430' (e.g., at the associated dashed curvilinear indicator), or the expected level thereof after any increase of volume of the absorbent 430.

Figure 5:
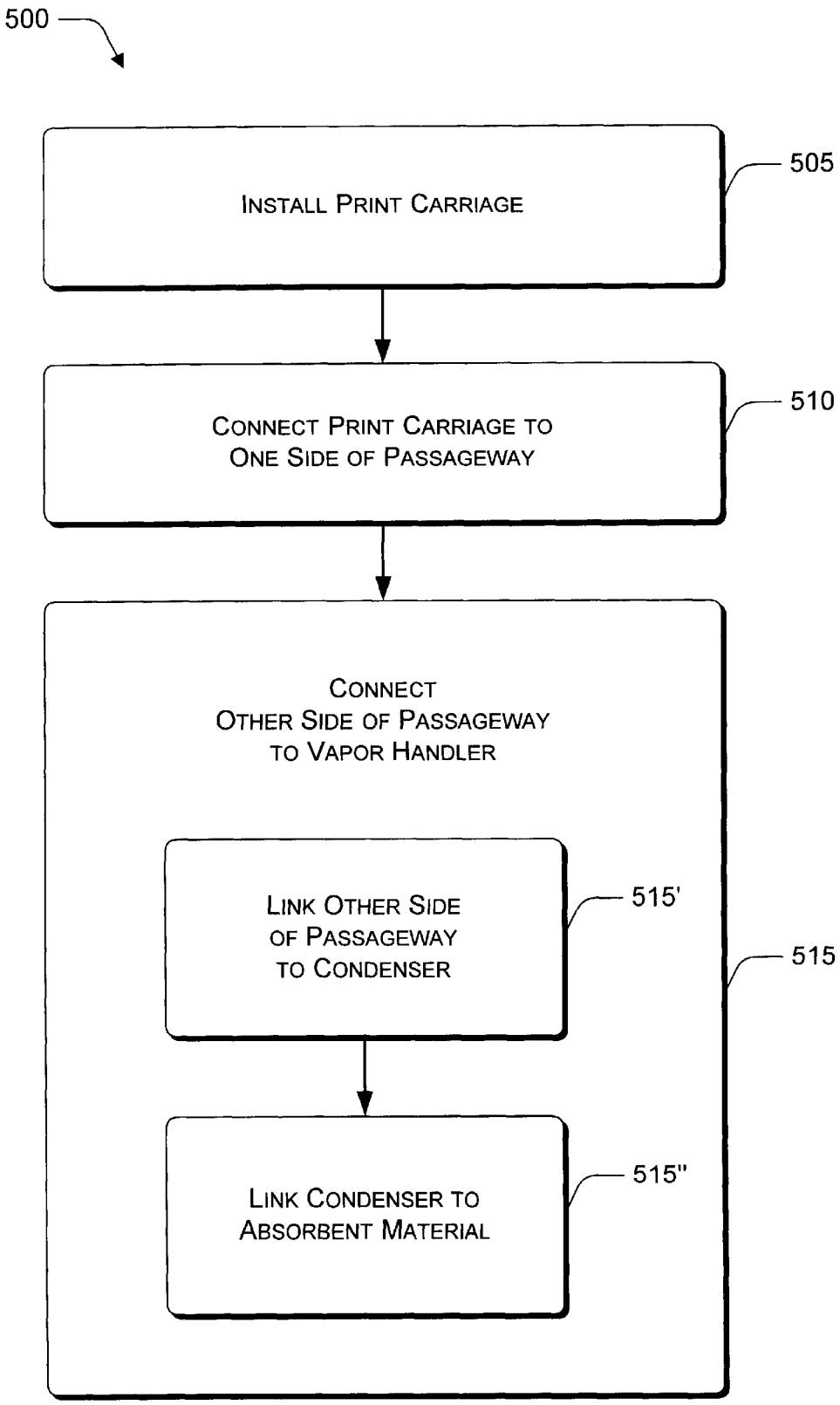
FIG. 5 illustrates an exemplary method in flowchart form for manufacturing an exemplary printing device implementation.

FIG. 5 illustrates generally at 500 an exemplary method in flowchart form for manufacturing an exemplary printing device implementation. The flowchart 500 relates to certain manufacturing schemes of many possible approaches to manufacturing printing devices. For example, a print carriage may be installed (block 505) into a printing device. One side of a passageway (e.g., that is capable of collecting vapors from or directing vapors away from the print carriage) may be connected to the print carriage (block 510). Another side of the passageway may be connected to a vapor handler (block 515) (e.g., directly if the vapor handler has been previously assembled). It should be noted that there may be more than two sides of the passageway that may be connected. Additionally, one or more implementations of connecting another side of the passageway to the vapor handler (of block 515) may entail linking another side of the passageway to a condenser (block 515') or linking the condenser to an absorbent material (block 515") (e.g., if the vapor handler has not been previously assembled).

It should be understood that many alternative manufacturing schemes may be employed. For example, a passageway may be connected to a vapor handler prior to, simultaneously with, or after connection of the passageway to a print carriage. Also, a passageway may be connected to one or both of a vapor handler and a print carriage prior to installation of either (or any) into a printing device. Furthermore, a passageway may be installed into a printing device prior to a vapor handler or a print carriage being installed into the printing device or being connected to the passageway (e.g., if the passageway is integral with/formed by a housing or other part of the printing device). As another alternative printing device manufacturing implementation, a printhead may be installed into a printing device, a vapor handler may be installed into the printing device (e.g., directly if pre-assembled or in parts (e.g., by linking one or more condensers to one or more absorbent materials) if not pre-assembled), and a passageway may be added and connected to each of the printhead and vapor handler.

Figure 6:
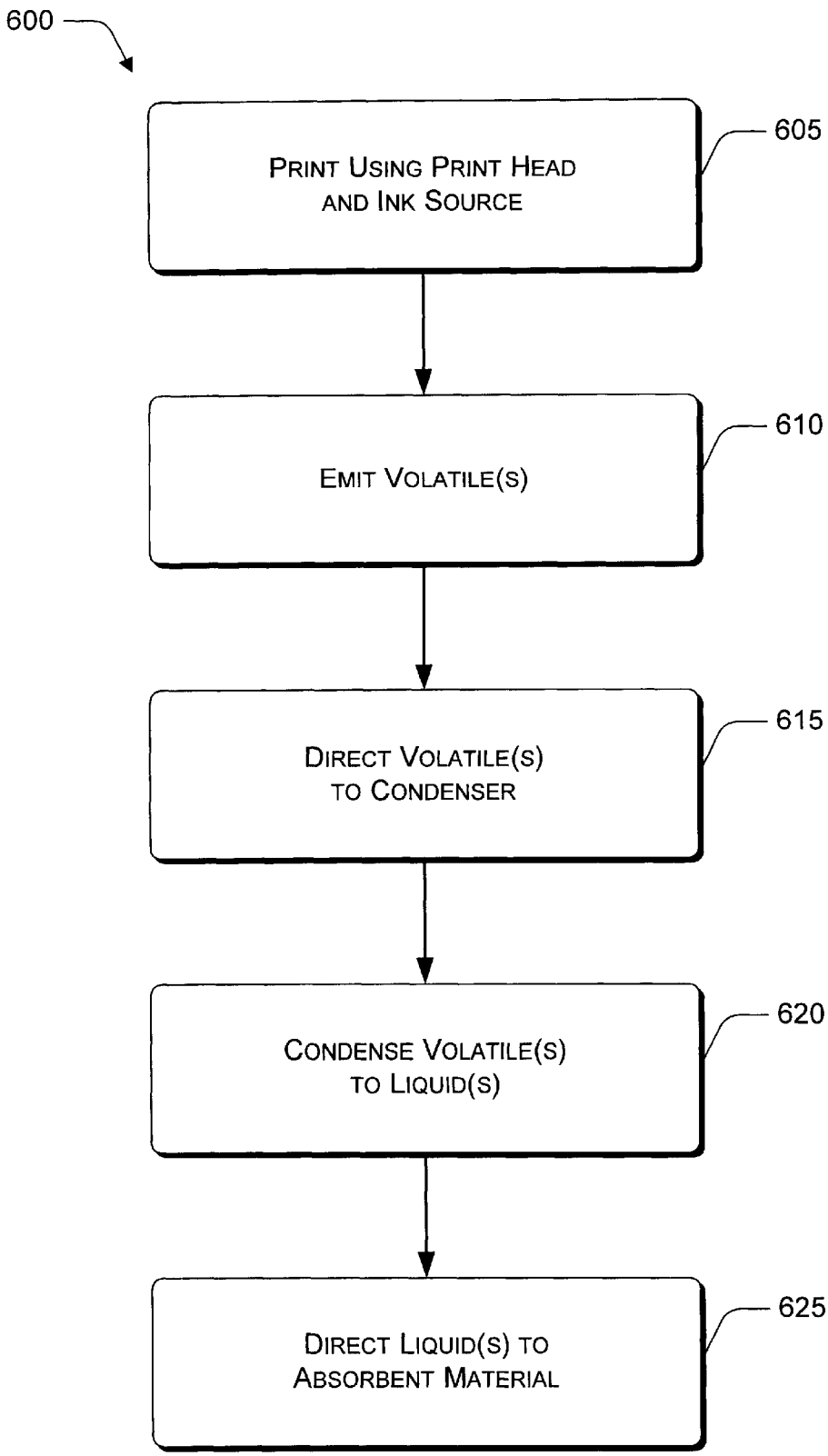
FIG. 6 illustrates an exemplary method in flowchart form for operating an exemplary printing device implementation.

FIG. 6 illustrates generally at 600 an exemplary method in flowchart form for operating an exemplary printing device implementation. The flowchart 600 relates to a printing operation in which (one or more) printheads and (one or more) ink sources may be used for printing (block 605). The printing operation may emit volatiles (block 610). These volatiles may include water vapor and one or more different types of oil vapor, for example. The volatiles may be directed along a passageway (which may be formed of a physically solid material, a flow of air within the printing device, some combination thereof, etc.) toward and to one or more condensers (block 615). The condenser may condense the volatiles into liquids (block 620). For example, the condenser may be set to a temperature such that oil vapors are condensed into oil liquids while at least most of the water vapor is not condensed into water liquid so that at least most of the water may be ejected while still in a gaseous phase. The amount of water vapor that is or may be condensed into water liquid may be set such that no or practically no oil remains in a gaseous phase after the condensing. The oil liquids and any water liquids may be directed to an absorbent material (block 625), while the water vapor is funneled beyond the condensers under, e.g., negative air pressure. Because at least most of the water is ejected as water vapor, very little or no relatively clean or pure (e.g., non-messy) water liquid is collected with or by the absorbent material, which might unnecessarily occupy space volume in, around, or through the absorbent material.

The absorbent material may be selected or designed so that the addition of oil liquids and any water liquids creates a solid or does not cause the material to cease being a solid. The waste having the absorbent material, oil liquids, and any water liquids (or a new substance derived from a combination thereof) may be disposed of as a solid at regular intervals or as needed, with the operator replacing the solid waste with new absorbent material. Thus, the absorbent material may be replaced, for example, individually (e.g., by pouring a powder, by inserting a gel pack, by placing a spongy or other porous solid in the vapor handler, etc.), along with a cartridge (e.g., by substituting a new cartridge formed of plastic or something similar with new absorbent material therein or thereon, etc.), along with a partially or entirely new vapor handler (e.g., by installing the partially or entirely new vapor handler, etc.), and so forth. The absorbent material replacement (whether individually, along with a cartridge, etc.) may be accomplished according to certain guidelines as specified by the manufacturer. The guideline may be based, for example, on the volume of ink used, the weight gain of the absorbent material (alone or with any cartridge), an elapsed time since a previous replacement, and so forth. Additionally, a printing device employing a vapor handler may be adapted to follow any such guidelines and alert a user/operator as to when it is appropriate, advisable, or necessary to replace the absorbent material or the absorbent material cartridge.

Although implementations of apparatuses, methods, systems, and arrangements have been illustrated in the accompanying Drawings and described in the foregoing Detailed Description, it will be understood that the present invention is not limited to the implementations explicitly disclosed, but is capable of numerous rearrangements, modifications, substitutions, etc. without departing from the spirit and scope set forth and defined by the following claims.

What is claimed is:

1. A printing device that collects at least one waste product of a printing operation, comprising:

a print carriage, said print carriage including an ink source;

a vapor handler, said vapor handler including a condenser and an absorbent material; and an air passageway, said passageway connecting said print carriage to said vapor handler.

2. The printing device of claim 1, wherein said condenser is interposed between the passageway and the absorbent material.

3. The printing device of claim 1, wherein the condenser comprises a cold finger.

4. The printing device of claim 1, wherein the condenser is configured to selectively condense the at least one waste product of the printing operation from a gas phase into a liquid phase.

5. The printing device of claim 4, wherein the at least one waste product of the printing operation comprises oil vapor and water vapor, the condenser being configured by setting the condenser to a temperature that selectively condenses the oil vapor to oil liquid while the temperature remains above that which would condense all of the water vapor.

6. The printing device of claim 1, wherein the absorbent material is a material selected from the group consisting of silica gel, cellulose fibers, polyvinyl alcohol, polyvinylpyrrolidone, polyethylene oxide, polyethylene glycol, polyacrylamide, calcium carbonate, or clay.

7. The printing device of claim 1, wherein said passageway includes a first opening and a second opening; the first opening connecting said passageway to said print carriage, and the second opening connecting said passageway to said vapor handler.

8. The printing device of claim 1, wherein said passageway directs the at least one waste product of the printing operation to the absorbent material using air pressure.

9. A printing device for disposing of oil vapor byproduct, comprising:

a print carriage, said print carriage including a printhead and an ink source, said print carriage configured to cause the printhead to eject ink from the ink source during a printing operation that creates oil vapor;

a vapor handler, said vapor handler including a condenser and an absorber; and a passageway, said passageway connecting said print carriage to said vapor handler, said passageway adapted to direct the oil vapor from said print carriage to said vapor handler;

wherein the condenser is configured to condense the oil vapor into oil liquid, and the absorber is configured to absorb the oil liquid.

10. The printing device of claim 9, wherein the condenser and the absorber are positioned such that gravity may propel the oil liquid from the condenser to the absorber.

11. The printing device of claim 9, wherein the absorbent material is a material selected from the group consisting of silica gel, cellulose fibers, polyvinyl alcohol, polyvinylpyrrolidone, polyethylene oxide, polyethylene glycol, polyacrylamide, calcium carbonate, or clay.

12. The printing device of claim 9, wherein the absorber is separated from ambient air by an oil-permeable membrane.

13. The printing device of claim 9, wherein said passageway comprises a manifold having a first orifice and a second orifice; the first orifice forming at least part of a juncture between the manifold and said print carriage, and the second orifice forming at least part of a juncture between the manifold and said vapor handler.

14. The printing device of claim 9, wherein the printing operation further creates water vapor along with the oil vapor, said passageway is further adapted to direct the water vapor along with the oil vapor from said print carriage to said vapor handler, the condenser is further configured selectively condense most of the oil vapor while not condensing most of the water vapor, and the absorber is further configured to absorb any condensed water vapor.

15. The printing device of claim 14, wherein said vapor handler further includes a source of air pressure, the air pressure capable of extracting the water vapor present between the condenser and the absorber.

16. A printing system for handling waste vapor created during printing, comprising:

a computing system; and a printing device, said printing device operably connectable to said computing system for receiving printing instructions therefrom, said printing device including:

an interface unit, the interface unit capable of interpreting printing instructions received from said computing system; and a print unit, the print unit including:

a printing mechanism, the printing mechanism creating oil vapor during printing;

a passageway, the passageway having a first point and a second point, the first point of the passageway connected to the printing mechanism; and a vapor handler, the vapor handler connected to the second point of the passageway, the vapor handler including a condenser that is capable of condensing the oil vapor into oil liquid and absorbent material that is capable of absorbing the oil liquid.

17. The system of claim 16, wherein the condenser is located closer to the second point of the passageway than is the absorbent material.

18. An apparatus for handling vapor in a printing process, comprising:

an ink source, said ink source including at least one pigment and oil;

a printing mechanism, said printing mechanism capable of applying the at least one pigment to a surface and producing oil vapor from the oil;

a condenser, said condenser capable of converting the oil vapor to oil liquid;

a passageway, said passageway including a first opening and a second opening; the first opening of said passageway at least proximate to said printing mechanism, and the second opening of said passageway at least proximate to said condenser; said passageway adapted to direct the oil vapor away from said printing mechanism and toward said condenser; and an absorbent material, said absorbent material capable of collecting and absorbing the oil liquid.

19. The apparatus of claim 18, further comprising:

an air pressure source, said air pressure source capable of creating air pressure to propel the oil vapor from said printing mechanism and to said condenser.

20. The apparatus of claim 19, wherein said ink source further includes water, said printing mechanism is further capable of producing water vapor from the water, said condenser is configured to not convert at least most of the water vapor to water liquid, said passageway is further adapted to direct the water vapor away from said printing mechanism and toward said condenser, said air pressure source is further capable of creating the air pressure to propel the water vapor from said printing mechanism and past said condenser, and said absorbent material is further capable of collecting and absorbing the water liquid.

21. The arrangement of claim 18, wherein the absorbent material is a material selected from the group consisting of silica gel, cellulose fibers, polyvinyl alcohol, polyvinylpyrrolidone, polyethylene oxide, polyethylene glycol, polyacrylamide, calcium carbonate, or clay.

22. A system for handling vapor produced in a printing operation, comprising:

means for producing oil vapor and water vapor from an ink supply;

means for condensing the oil vapor into oil liquid;

means for guiding the oil vapor and the water vapor from the means for producing oil vapor and water vapor from an ink supply to the means for condensing the oil vapor into oil liquid; and means for collecting the oil liquid into a solid.

23. The system for handling vapor of claim 22, wherein said means for producing oil vapor and water vapor from an ink supply comprises means for printing.

24. The system for handling vapor of claim 22, wherein said means for collecting the oil liquid into a solid comprises an absorbent material.

25. The system for handling vapor of claim 22, further comprising:

means for extracting the water vapor beyond the means for condensing the oil vapor into oil liquid.

26. A method for handling vapor produced during printing, comprising the steps of:

printing using an ink source;

emitting water vapor and oil vapor as byproducts of printing;

directing the water vapor and the oil vapor toward a condenser;

condensing the oil vapor into oil liquid by cooling the oil vapor; and absorbing the oil liquid by an absorbent material.

27. The method of claim 26, wherein said step of directing the water vapor and oil vapor comprises the step of:

forcing the water vapor and the oil vapor along a passageway under air pressure established therein.

28. The method of claim 27, wherein the air pressure is established via a partial vacuum.

29. A method for handling and constraining waste produced during printing, comprising the steps of:

printing using an ink that includes a first solvent and a second solvent, a first volatility of the first solvent being lower than a second volatility of the second solvent;

emitting, during said step of printing, a first vapor that is related to the first solvent and a second vapor that is related to the second solvent;

funneling the first vapor and the second vapor toward a condensing unit;

condensing, at the condensing unit, the first vapor into a first liquid, a temperature of the condensing unit set responsive to a first temperature corresponding to the first volatility and a second temperature corresponding to the second volatility;

directing the first liquid into an absorbent material; and funneling the second vapor beyond the condensing unit.

30. The method of claim 29, wherein the first solvent comprises oil and the second solvent comprises water.

31. The method of claim 29, wherein said steps of funneling are effectuated using, at least partly, negative air pressure.

32. The method of claim 29, wherein the temperature of the condensing unit is set (i) approximately at or above the second temperature and (ii) aproximately at or below the first temperature.

33. The method of claim 29, wherein said step of condensing comprises the step of:

condensing, at the condensing unit, part of the second vapor into a second liquid; and wherein said step of directing comprises the step of:

directing the second liquid into the absorbent material.

* * * * *